US006538239B1

(12) United States Patent
Anderson et al.

(10) Patent No.: US 6,538,239 B1
(45) Date of Patent: Mar. 25, 2003

(54) INDUCTION HEATING DEVICE FOR METAL PIECES

(76) Inventors: Walter James Anderson, 5 The Hollows, Auckley, Doncaster (GB), DN9 3LB; Philip Anthony Browning, 13 Sylvan Grove, Bamber, Preston (GB), PR5 6YU; Barrie Higgins, 29 Kepple Close, Rossington, Doncaster (GB), DN11 0XE; Paul John Spencer, 6 Chapel Rise, Worthington, Ashby de la Zouch (GB), LE65 1RX; Brian Kenneth Powell, Sunnyside Cottage, St Johns Road, Laughton-en-le-Morthen, Dinnington, Sheffield (GB), 525 1YL ( * ) Notice: Subject to any disclaimer, the term of this patent is extended or adjusted under 35 U.S.C. 154(b) by 0 days.

(21) Appl. No.: 09/423,839

(22) PCT Filed: May 1, 1998

(86) PCT No.: PCT/GB98/01290

§ 371 (c)(1),
(2), (4) Date: Nov. 12, 1999

(87) PCT Pub. No.: WO98/52385

PCT Pub. Date: Nov. 19, 1998

(Under 37 CFR 1.47)

(30) Foreign Application Priority Data

May 13, 1997 (GB) ..... 9709557
Dec. 3, 1997 (GB) ..... 9725737

(51) Int. Cl.[7] ..... H05B 6/10; H05B 6/44

(52) U.S. Cl. ..... 219/635; 219/646; 219/669; 219/670; 219/672; 336/221

(58) Field of Search ..... 219/635, 645, 219/646, 669, 670, 672, 676; 336/221

(56) References Cited

U.S. PATENT DOCUMENTS

| | | | | | |
|---|---|---|---|---|---|
| 2,079,610 | A | * | 5/1937 | Harris, Jr. | 219/669 |
| 3,008,026 | A | * | 11/1961 | Kennedy | 219/670 |
| 3,388,230 | A | * | 6/1968 | Cunningham et al. | 219/669 |
| 4,311,896 | A | * | 1/1982 | Junya | 219/670 |
| 5,023,419 | A | * | 6/1991 | Langstedt | 219/670 |
| 5,373,144 | A | * | 12/1994 | Thelander | 219/670 |
| 5,951,903 | A | * | 9/1999 | Isoyama et al. | 219/670 |

FOREIGN PATENT DOCUMENTS

| | | | |
|---|---|---|---|
| DE | 277 870 | * | 9/1914 |
| WO | PCT/GB98/01290 | | 5/1998 |

* cited by examiner

*Primary Examiner*—Philip H. Leung
(74) *Attorney, Agent, or Firm*—Watov & Kipnes, P.C.; Kenneth Watov

(57) ABSTRACT

A magnetic heating device comprising three electrical coils, each coil being wound around a respective magnetic yoke having a gap therein, the three yokes being arranged such that the gaps are adjacent to each other or coincident, an article to be heated being located, in use, in the gaps in the three yokes, so as to direct the magnrtic field generated in each yoke by its respective coil through the articles, each coil being connected to a respective different phase of a three phase low frequency alternating electrical supply, and one of the coils being wound in the opposite direction to the other two coil.

7 Claims, 5 Drawing Sheets

INDUCTION HEATING DEVICE FOR METAL PIECES

FIELD OF THE INVENTION

This invention relates to a magnetic heating device, for example for use in heat treatment of metal components.

BACKGROUND TO THE INVENTION

The use of alternating magnetic fields for the heat treatment of metallic articles has been known for many years. Examples of disclosures of such techniques are: U.S. Pat. No. 1,335,453; U.S. Pat. No. 3,965,321; U.S. Pat. No. 4,281,234; U.S. Pat. No. 4,673,781; U.S. Pat. No. 4,761,527; U.S. Pat. No. 4,156,097; EP 0183209; and EP 0459837. All of these disclosures relate to single phase arrangements in which one or two coils are wound around a C-shaped core, with the article to be treated being placed in the gap in the C.

DE-A-277870 discloses an arrangement in which three-phase current is used to supply three coils on three C-shaped magnetic yokes to melt a metal article placed in the common air gaps in the yokes. One of the coils is connected or wound in the opposite direction to the other two.

Greater heating efficiency can be obtained by the use of three phase electrical supply to three coils or pairs of coils around separate cores.

SUMMARY OF THE INVENTION

According to the invention there is provided a magnetic heating device comprising three electrical coils, each coil being wound around a respective magnetic yoke having a gap therein, the three yokes being arranged such that the gaps are adjacent to each other or coincident, an article to heated being located. In use, in the gaps in the three yokes, so as to direct the magnetic field generated in each yoke by its respective coil through the article, each coil being connected to a respective different phase of a three phase low frequency alternating electrical supply, and one of the coils being wound in the opposite direction to the other two coils.

By winding one coil in the opposite direction to the other two (or connecting electrically in the reverse direction—the effect is the same), when the magnetic field produced by one phase is at 100%, the other two phases are producing magnetic fields in the same direction and at a significant proportion of the full field, for example at least 50%.

The magnetic fields generated by the three C-shaped yokes are coupled with each other, either by a common polo piece linking the yokes on each side of the air gap, when the yokes are arranged side by side, or by arranging for the magnetic fields to be directed through the same part of the article to be heated, as in the case where the yokes are arranged at 120° to each other.

Preferably. three pairs of coils are used, each pair being wound around a respective one of the magnetic yokes, the coils in the pair being connected electrically, either in series or in parallel. Preferably, the coils of each pair are arranged one on each side of the air gap, as close as possible to the air gap.

The three phases may be connected in star or delta formation.

Each coil or pair of coils is either mounted around opposite ends of a single C-shaped core or yoke, preferably made up of thin insulated silicon steel plate, or around three individual C-shaped cores, preferably of the same type. Each pair of coils must be connected so that the current in one flows in the opposite direction to the current in the other coil. One pair of coils must be connected so that the windings are connected in the opposite direction to the other two pairs of coils.

The C-shaped cores or yokes are preferably constructed so that the air gap may be varied. This may be achieved by slidably mounting the upper part of the C with, for example, a hydraulic ram or the like to raise and lower the upper part to change the size of the air gap. In this way, the magnetic flux can be concentrated as efficiently as possible in the article to be heated.

As each electrical supply phase voltage fluctuates between positive and negative voltages, each pair of coils creates a magnetic flux which passes around the core and through the air gap. The polarity of the magnetic field in the air gap oscillates. If a ferrous or non-ferrous metal part is placed in the air gap, the following will happen.

1. In the case of a ferrous part, the magnetic domains within the material will be stressed in fluctuating directions, due to magnetic attraction, creating hysteresis loss within the metal, which will rapidly heat up uniformly;
2. In the case of most non-ferrous metals, the crystalline structures will be stressed by fluctuating magnetic repulsion which again will cause the metal to heat up.

Preferably, the coils or pairs of coils, where separate cores or yokes are used, will be arranged side by side along the article to be heated, but may be arranged radially around a cylindrical or tubular article with the axes through the gaps spaced by 120°. In this case, the apparatus may be used for stress-relieving welds in tubes.

BRIEF DESCRIPTION OF THE DRAWINGS

In the drawings, which illustrate exemplary embodiments of the invention.

DETAILED DESCRIPTION OF THE ILLUSTRATED EMBODIMENTS

Figure 1:
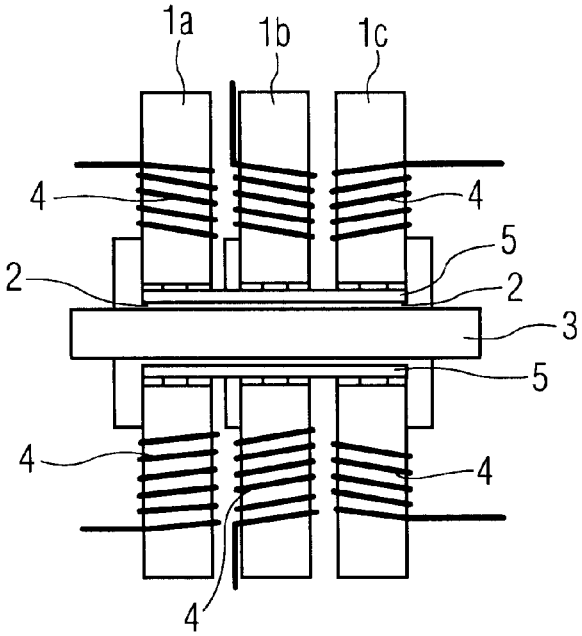
FIG. 1 is a diagrammatic front elevation of an apparatus according to one embodiment of the invention.
Figure 2:
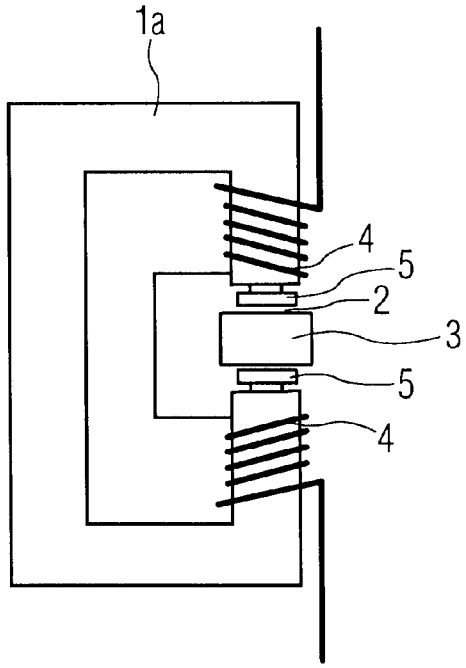
FIG. 2 is an end view of the apparatus shown in FIG. 1.

Referring first to FIGS. 1 and 2. the apparatus comprises three generally C-shaped magnetic yokes 1*a*, 1*b*, and 1*c*, arranged side by side with their air gaps 2 aligned to receive an elongate metallic workpiece 3 within them. Each yoke 1 has two coils 4 wound therearound, one each side of the air gap 2, the coils being in opposite directions to each other and being connected in series in one phase of the three phase alternating current electrical supply. One of the yokes 1*c* has its coils wound (or connected) in the opposite direction to those of the other two coils, so that the field generated by the third of the phases is reversed relative to the others.

Bars 5 link the yokes 1 together at each side of the air gap 2. The bars 5 are formed of insulated laminated steel with the laminations extending lengthways along them, and are suitably removably mounted on the ends of the cores or yokes. Thus, for example, instead of distributing the flux along the bar, it may be concentrated at one or more points along the bar by means of concentrators, being laminated steel parts upstanding from the surface of, but integrally formed with, the bars, to provide for localised heating.

Figure 5:
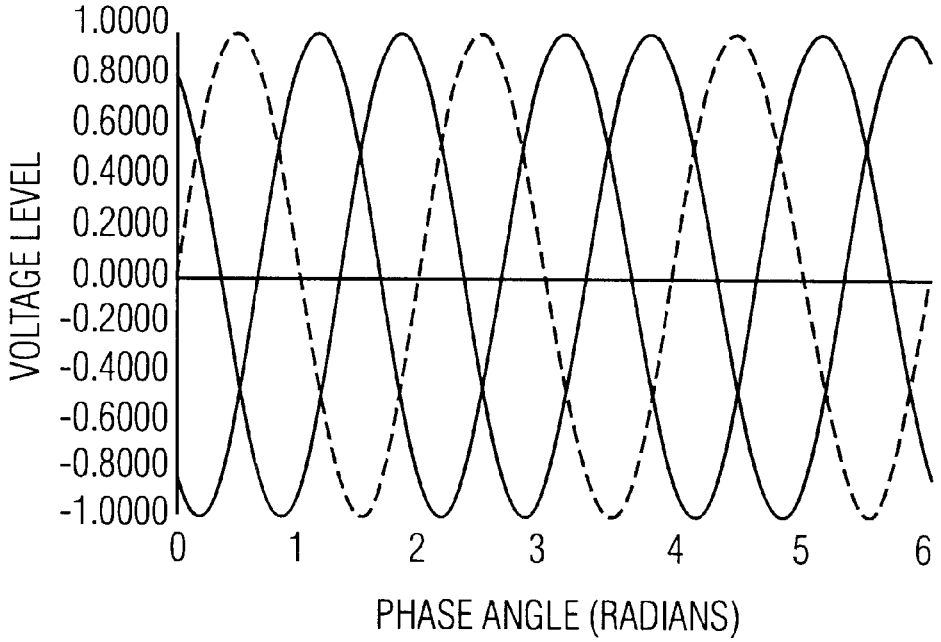
FIG. 5 is a graph representing voltage against phase angle in a three phase electrical supply.
Figure 6:
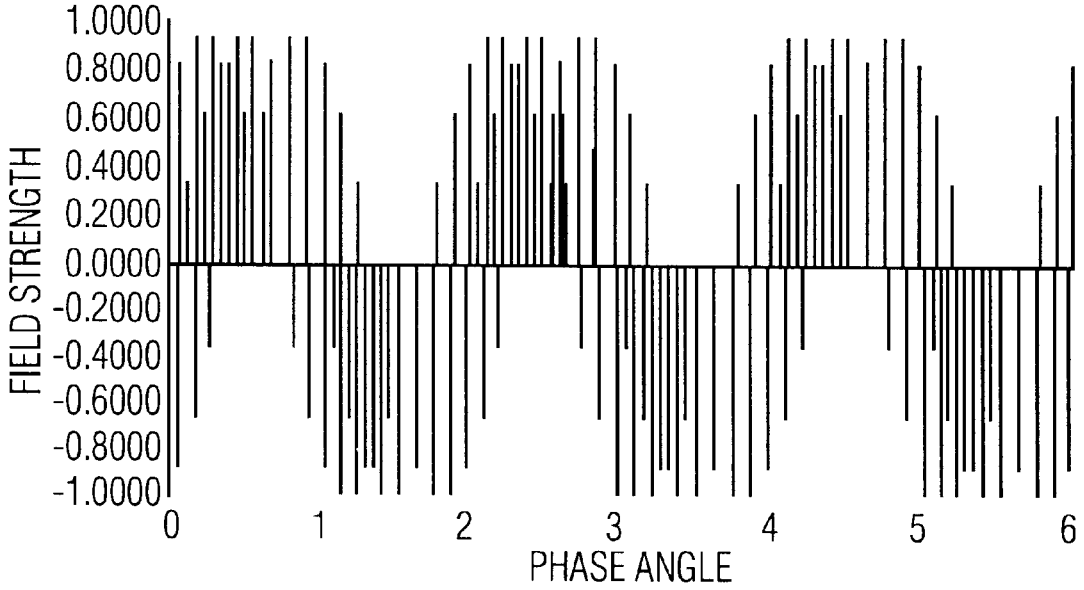
FIG. 6 is a graph representing magnetic field strength against phase angle for the three phases in the apparatus of FIGS. 1 and 2.
Figure 7:
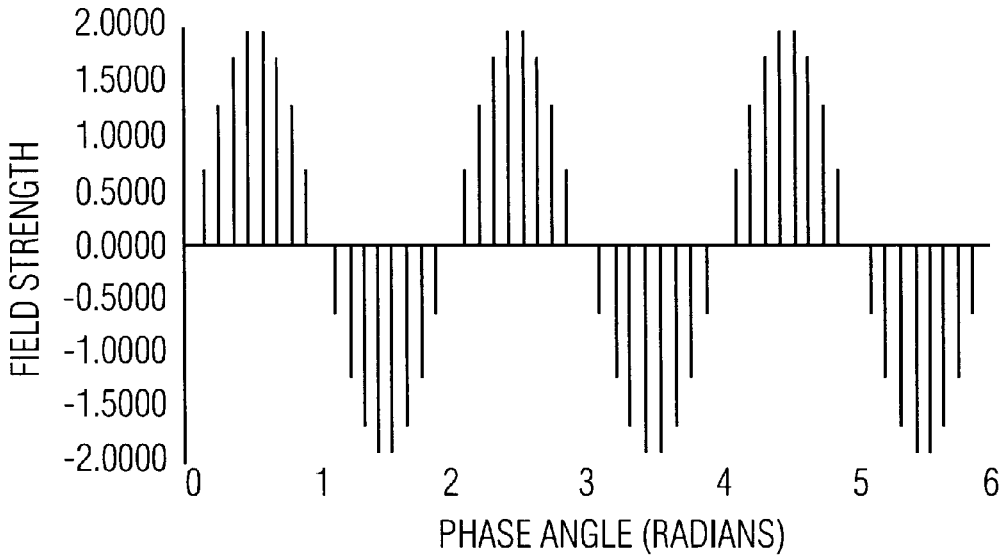
FIG. 7 is a graph corresponding to FIG. 6 and representing the summed magnetic field strength against phase angle.

The conventional relationship between the voltages in the three phases is illustrated in FIG. 5. It will be seen that at the peak voltage for any given phase, the two other phases are at a voltage opposite in sign and approximately 50% of the peak magnitude. By connecting one of the phases in the opposite direction (or winding the coils in the opposite directions) to those in the other phases, at any given instant the magnetic fields induced in the workpiece 3 by the three phases have the same sign, and therefore add, as may be seen from FIG. 6, rather than cancel, greatly increasing the heating efficiency. The resultant summing effect can be seen more clearly from FIG. 7.

Figure 3:
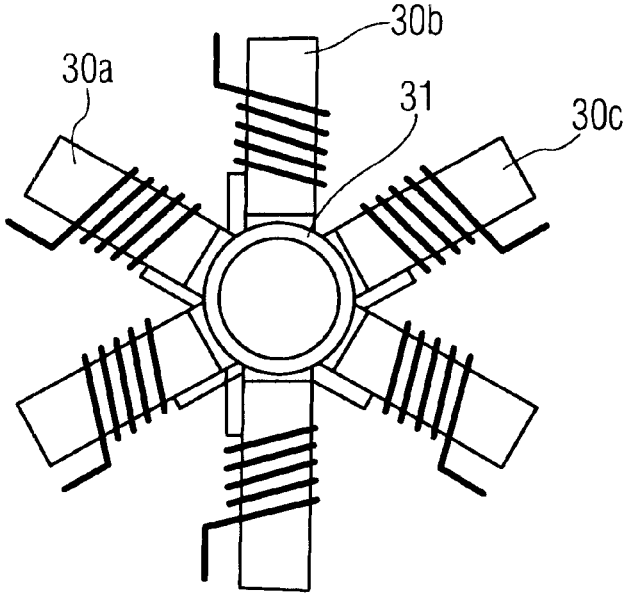
FIG. 3 is a diagrammatic end elevation of an apparatus according to a second embodiment of the invention.

FIG. 3 shows an alternative arrangement in which three generally C-shaped magnetic yokes 30*a*, 30*b* and 30*c*. are arranged at 120° spacing so that their air gaps coincide radially at one point on the workpiece 31. As with the embodiment shown in FIGS. 1 and 2, the coils on two of the yokes 30*a* and 30*b* are wound in the same directions, while those on the third yoke 30*c* are wound in the opposite directions (or wound in the same directions but connected in the opposite direction). The yokes are constructed with differing depths, so as to be able to be mounted one inside another, permitting the air gaps to concentrate the magnetic flux at one point on a workpiece 31.

Figure 4:
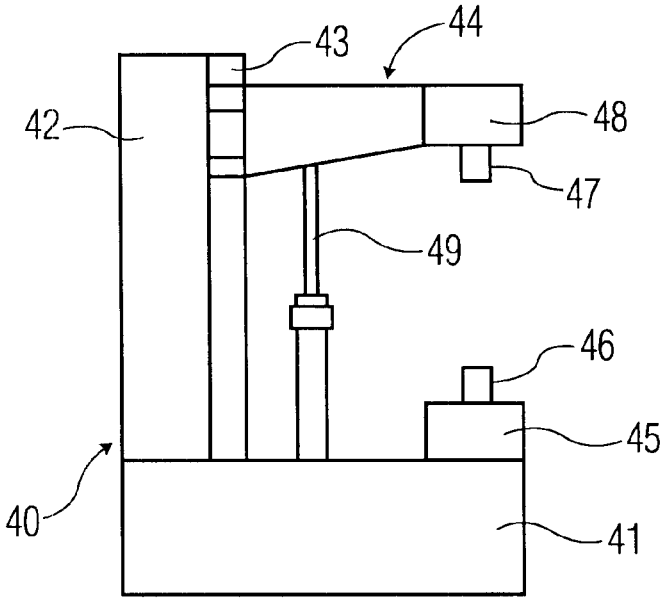
FIG. 4 is a diagrammatic side view of an alternative apparatus to that shown in FIG. 1.

FIG. 4 illustrates one preferred embodiment in which the air gap is made adjustable, to accommodate different sizes of workpiece, by constructing the upper part of the generally C-shaped yoke as a separate element which can slide relative to the remainder of the yoke. The yoke 40 comprises a base part 41 from which extends a vertical rear part 42, along which a pair of slide rails 43 are mounted. The upper part 44 of the yoke is slidably mounted in the slide rail so as to maintain magnetic contact with the rear part 42. A first coil 45 is mounted on the base part 41 and a first coupling bar 46 extends transversely across the cores and coils 45. A second coupling bar 47 extends across the second coils 48, which are in turn mounted on the upper parts 44. A pair of hydraulic or pneumatic rams 49 extend between the base part 41 and a common support for the upper parts 44 to support, raise and lower the upper parts 44. thereby varying the air gap between the coupling bars 46 and 47. It will be appreciated that, although only one pair of coils is visible in the view of FIG. 4, the apparatus is generally of the type illustrated in FIG. 1, having three pairs of yokes and associated coils, side by side.

Figure 8:
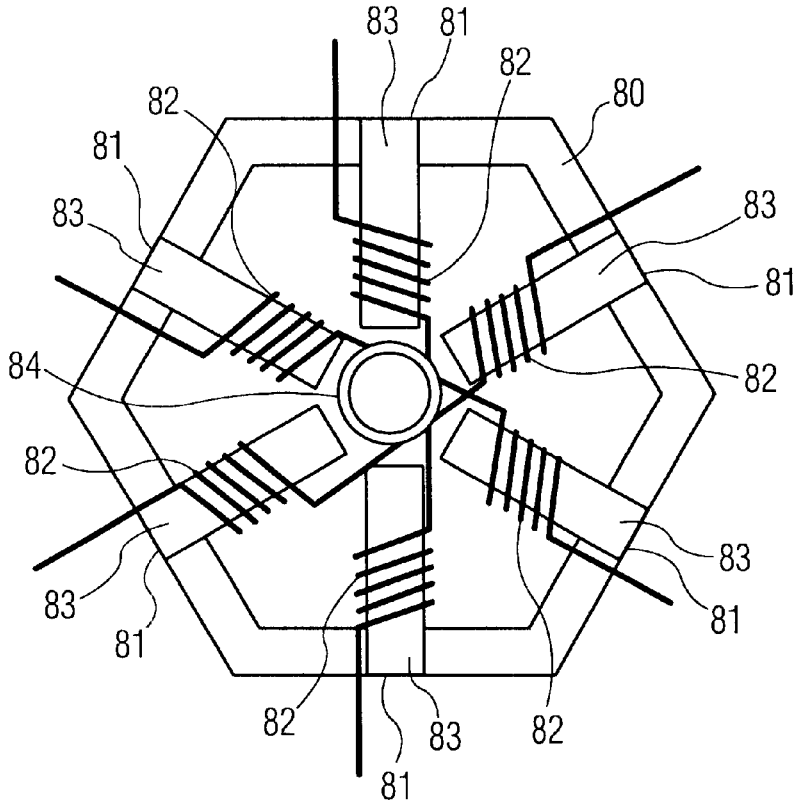
FIG. 8 is a diagrammatic front elevation of an apparatus according to another embodiment of the invention.
Figure 9:
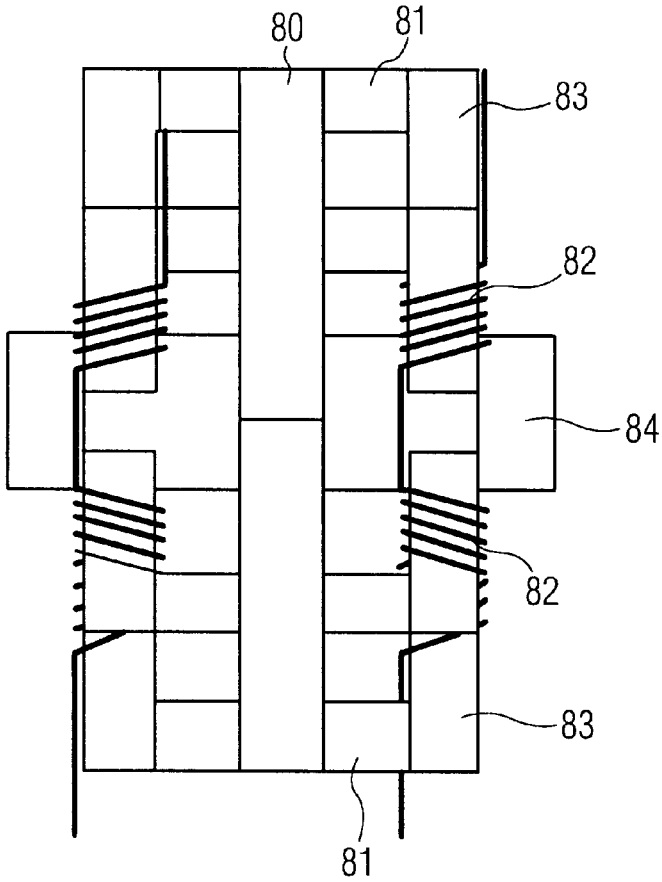
FIG. 9 is a side elevation of the apparatus shown in FIG. 8.

Referring now to FIGS. 8 and 9, a further embodiment has a hexagonal frame 80, each side of which has an arm 81 projecting from its centre normally to the plane of the frame. Each arm 81 has a coil 82 wound around it, the coils 82 being electrically connected in diametrically-opposed pairs, the pairs being connected to respective phases of a three-phase alternating electric supply. The coils 82 in one pair are wound in the opposite direction to those in the other two pairs, for example anticlockwise as opposed to clockwise for the other two pairs, so that the direction of the magnetic field induced is reversed relative to the other pairs.

Each of the arms 81 has a pole piece 83 mounted on the end thereof so as to be movable radially inwardly and outwardly as well as along the arm 81 towards and away from the plane of the frame 80, while maintaining the continuity of the magnetic path therethrough. This arrangement permits precise adjustment of the pole pieces 83 relative to the workpiece 84 to be treated. The workpiece 84 is positioned so as to extend through the frame 80 and between the pole pieces 83, and may be carried in such a way as to permit it to be slid axially to enable progressive heat treatment along its length.

Figure 10:
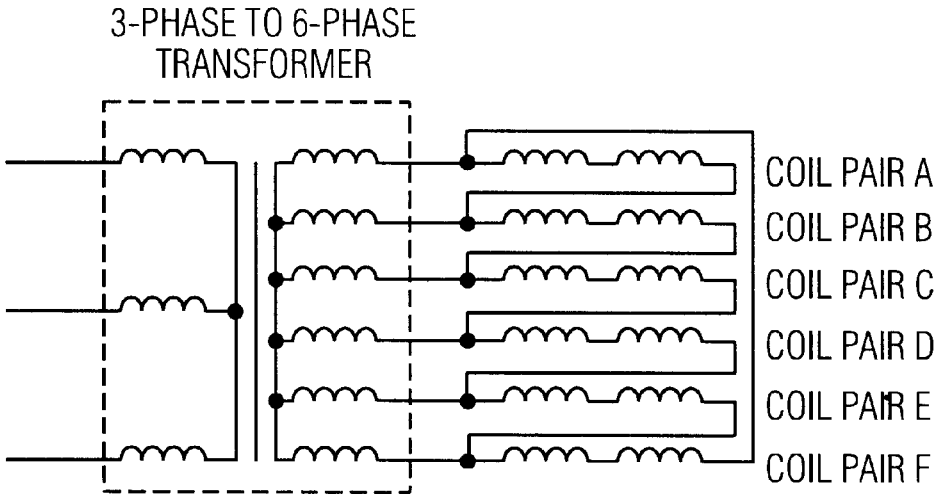
FIG. 10 is a diagram illustrating a 3-phase to 6-phase transformer.

It will be appreciated that it would be possible to extend a second set of the rms 81 from the opposite face of the frame 80, the second set of arms having their own coils and pole pieces. The coils in the second set would then be connected, along with those In the firstt set, to the thre-phase supply through a three-phase to six-phase transformer having a six coils A–F as illustrated in FIG. 10.

What is claimed is:

1. A magnetic heating device comprising three electrical coils, each coil being wound around a respective magnetic yoke having a gap therein, the three yokes being arranged such that the gaps are adjacent to each other or coincident, an article to be heated being located, in use, in the gaps in the three yokes, so as to direct the magnetic field generated in each yoke by its respective coil through the article, each coil being connected to a respective different phase of a three phase low frequency alternating electrical supply, and one of the coils being wound in the opposite direction to the other two coils, characterised in that the three yokes are arranged at 120° to each other with the axis through each gap intersecting, the three yokes share a common closed loop in the form of a hexagon with each of the three yokes having components extending from respective sides thereof.

2. A magnetic heating device according to claim 1, wherein each yoke is in the form of a rectangular frame, the gap being in one side of the frame.

3. A magnetic heating device according to claim 1, wherein each coil is divided into two parts connected in series, the two parts being located adjacent to the gap, one on each side thereof.

4. A magnetic heating device according to claim 1, wherein the yokes are formed from laminated thin insulated plates.

5. A magnetic heating device according to claim 4, wherein the plates consist of silicon steel material.

6. A magnetic heating device according to claim 1, wherein a portion of each yoke is movable relative to the remainder of the yoke, whereby the size of the gap may be varied.

7. A magnetic heating device according to claim 6, including hydraulic or pneumatic rams to control the variation in the size of the gaps.

* * * * *